US006981679B1

(12) United States Patent
Mullen

(10) Patent No.: US 6,981,679 B1
(45) Date of Patent: Jan. 3, 2006

(54) MOUNTING BRACKET FOR LIGHT FIXTURE

(76) Inventor: Nate Mullen, 1240 Simpson Way, Escondido, CA (US) 92029

( * ) Notice: Subject to any disclaimer, the term of this patent is extended or adjusted under 35 U.S.C. 154(b) by 15 days.

(21) Appl. No.: 10/701,313

(22) Filed: Nov. 3, 2003

(51) Int. Cl.
*B42F 13/00* (2006.01)

(52) U.S. Cl. ..... 248/344; 248/342; 248/343; 362/404

(58) Field of Classification Search ..... 248/342, 248/343, 344; 362/404, 363, 406, 407
See application file for complete search history.

(56) References Cited

U.S. PATENT DOCUMENTS

| | | | | | |
|---|---|---|---|---|---|
| 1,177,232 | A | | 3/1916 | Chisolm | |
| 1,630,958 | A | | 5/1927 | Mauch | |
| 1,659,404 | A | | 2/1928 | Lipschutz | |
| 1,690,941 | A | * | 11/1928 | Nickerson | 248/327 |
| 1,727,368 | A | | 9/1929 | Eustice | |
| 2,400,801 | A | | 5/1946 | Albin | |
| 2,448,001 | A | * | 8/1948 | Maurette | 248/343 |
| 2,456,792 | A | | 12/1948 | Ohm | |
| 2,461,487 | A | | 2/1949 | Wagstaff | |
| 3,060,538 | A | | 10/1962 | Simi | |
| 3,301,518 | A | | 1/1967 | Yetter et al. | |
| 3,356,840 | A | * | 12/1967 | Cohen | 174/54 |
| 3,374,919 | A | | 3/1968 | De Vos | |
| 3,561,719 | A | * | 2/1971 | Grindle | 248/343 |
| 3,589,660 | A | * | 6/1971 | Dunckel | 248/343 |
| 3,694,649 | A | | 9/1972 | Thompson | |
| 5,242,269 | A | * | 9/1993 | Chang | 416/244 R |
| 5,249,112 | A | | 9/1993 | Bray | |
| 5,449,259 | A | | 9/1995 | Clohessey | |
| 5,624,202 | A | | 4/1997 | Grierson | |
| 5,730,522 | A | | 3/1998 | Wyke et al. | |
| 6,283,430 | B1 | | 9/2001 | Schubert et al. | |
| 6,336,613 | B1 | * | 1/2002 | Roth | 248/27.1 |
| 6,669,159 | B1 | * | 12/2003 | Hsu | 248/343 |
| 6,682,036 | B1 | * | 1/2004 | Hsu | 248/343 |
| 6,732,991 | B1 | * | 5/2004 | Zakrzewski et al. | 248/317 |

* cited by examiner

*Primary Examiner*—Ramon O. Ramirez
*Assistant Examiner*—Steven Marsh
(74) *Attorney, Agent, or Firm*—Kelly Lowry & Kelley, LLP

(57) ABSTRACT

The present invention is an apparatus which facilitates the installation, maintenance, service, and/or replacement of a light fixtures on a substrate. The inventive apparatus comprises a main brace, main clamp, and a universal nut. The main brace ideally consists of two mounting surfaces and one support surface having a clamp channel. The main clamp consists of one or more retaining spring arms and retaining teeth and attaches to the main brace adjacent to the clamp channel. The main clamp is affixed to the main brace through the use of mechanical securing means. The universal nut has a threaded bore, a circumferential channel, and one or more retaining notches. The threaded bore of the universal nut is designed to receive a threaded mounting stem which may be attached to a light fixture. Either with or without a mounting stem, the universal nut slides into the main clamp, which is attached to the main brace. When the universal nut is in the appropriate position, the retaining teeth of the main clamp interlock with the retaining notches of the universal nut to secure it in place. In use, the mounting bracket may be secured to a tree, building, or other surface by securing the two mounting surfaces using screws or other mechanical securing means. The light fixture may then be attached separately to the universal nut and then inserted into the clamp channel.

3 Claims, 5 Drawing Sheets

MOUNTING BRACKET FOR LIGHT FIXTURE

BACKGROUND OF THE INVENTION

1. Field of the Invention

The present invention is directed toward apparatuses for mounting light fixtures or other means to a substrate. The inventive structure permits ease of installation, maintenance, service and replacement of a light fixture.

2. Description of the Related Art

In the prior art, numerous means of securing light fixtures to substrates exist, but all consist of one or more drawbacks. Typical prior art means for securing light fixtures consist of mechanical securing means including the following: using straps to hold the light fixture to the substrate; or attaching the light fixture directly to the substrate, i.e. screws, nails, etc. Each of these means shared the same drawback. Installation was cumbersome and difficult because of the need to maintain the light fixture in position while securing the mechanical securing means. If the light fixture needed to the maintained, serviced, or even replaced, it was required to completely remove the prior art mechanical securing means. The previously necessary steps involved in completely removing the prior art securing means resulted in a higher cost of time and money.

BRIEF SUMMARY OF THE INVENTION

The main object of this invention is to provide an apparatus which facilitates securing a light fixture to a substrate.

Another object of this invention is to provide an apparatus which expedites installing, maintaining, servicing, and/or replacing a light fixture, thereby saving time and money.

The present invention comprises a main brace, main clamp, and a universal nut. The main brace consists of two mounting surfaces and one support surface having a clamp channel. The main clamp consists of one or more retaining spring arms and retaining teeth and attaches to the main brace adjacent to the clamp channel. The main clamp is affixed to the main brace through the use of mechanical securing means. The universal nut has a threaded bore, a circumferential channel, and one or more retaining notches. The threaded bore of the universal nut is designed to receive a threaded mounting stem which may be attached to a light fixture. Either with or without a mounting stem, the universal nut slides into the main clamp, which is attached to the main brace. When the universal nut is in the appropriate position, the retaining teeth of the main clamp interlock with the retaining notches of the universal nut to secure it in place. In use, the mounting bracket may be secured to a tree, building, or other surface by securing the two mounting surfaces using screws or other mechanical securing means. The light fixture may then be attached separately to the universal nut and then inserted into the clamp channel.

The inventive mounting bracket consists of a structure that provides for the secure and stable mounting of light fixtures to a substrate. The inventive apparatus also provides for ease in removal of a mounted lighting fixture should the light fixture need to be maintained, serviced, or replaced.

DETAILED DESCRIPTION OF THE INVENTION

The instant invention is designed to secure a lighting fixture to a substrate. The mounting bracket (10) has application in areas other than light fixtures, as will become apparent. The device comprises unique utilitarian features.

Figure 1:
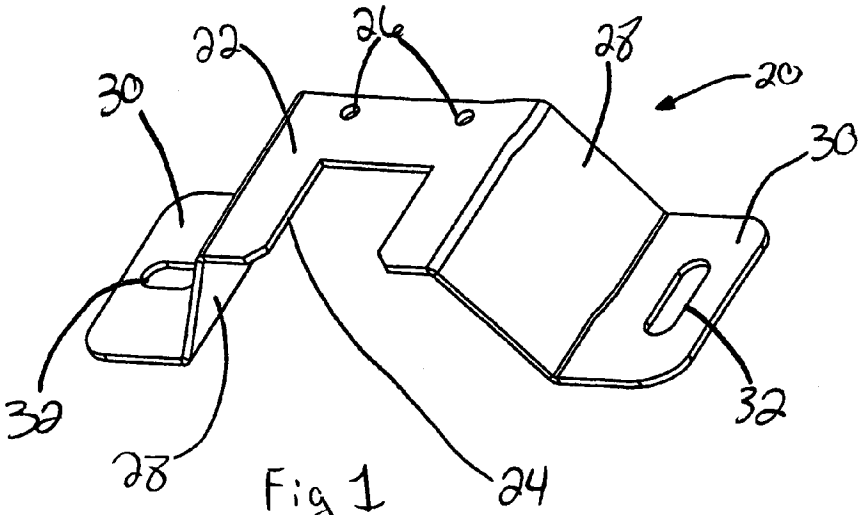
FIG. 1 shows an elevated perspective view of the main brace of the inventive apparatus.
Figure 2:
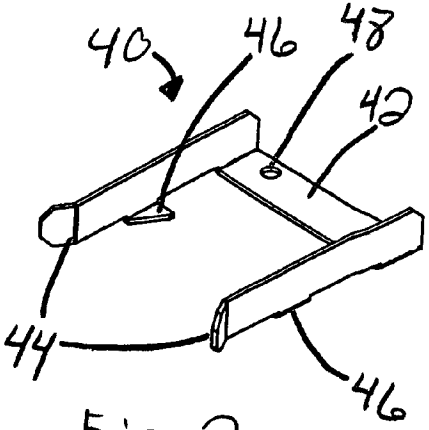
FIG. 2 shows an elevated perspective view of the main clamp of the inventive apparatus.
Figure 3:
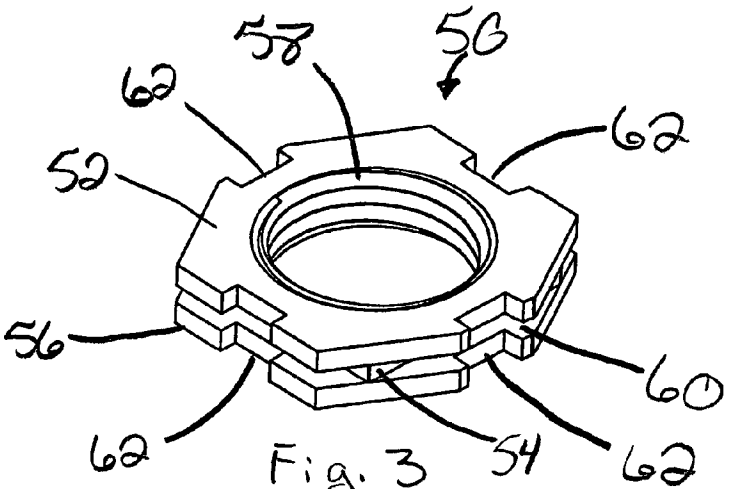
FIG. 3 shows an elevated perspective view of the universal nut of the inventive apparatus.
Figure 4:
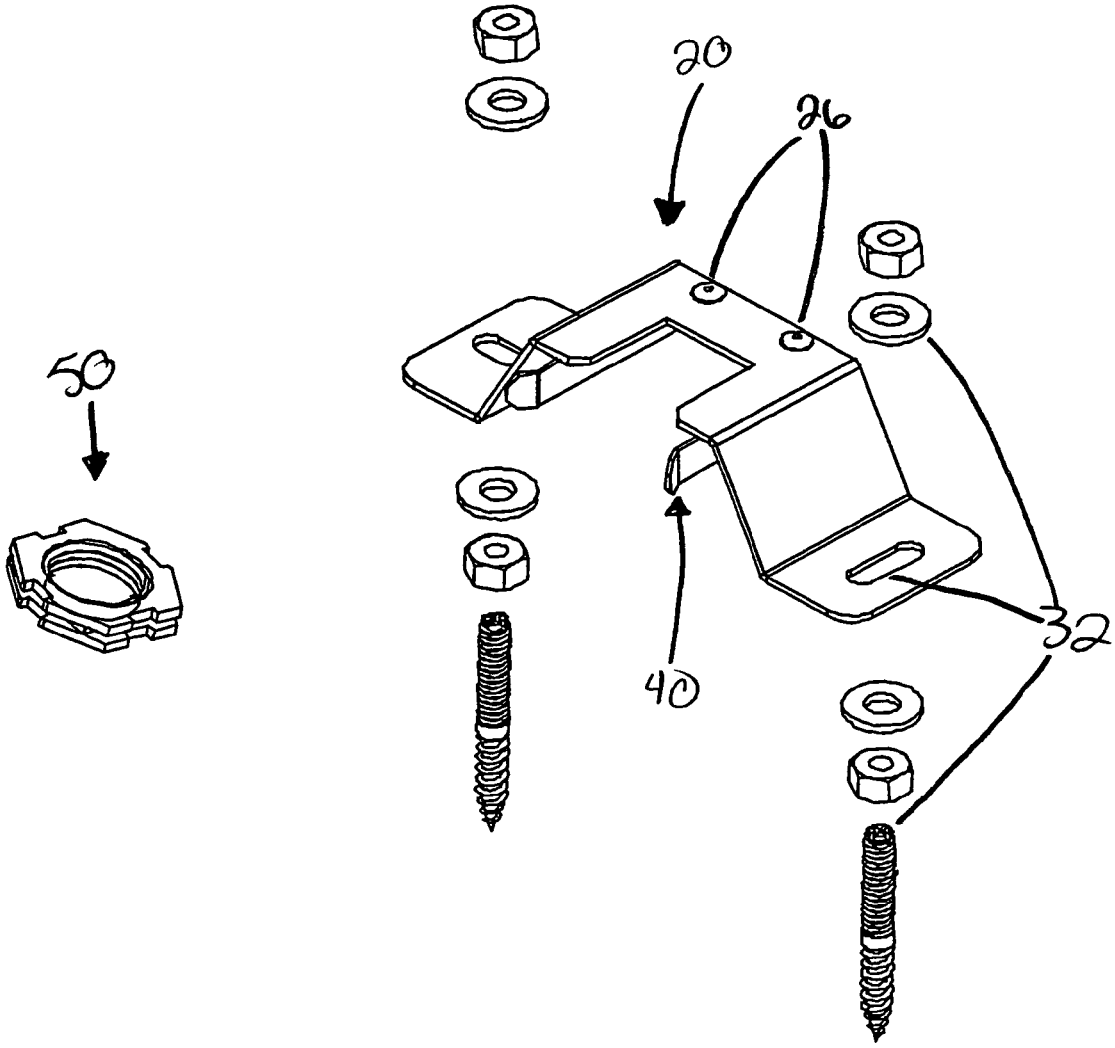
FIG. 4 shows an exploded, elevated perspective view of the mounting bracket of the inventive apparatus.
Figure 5:
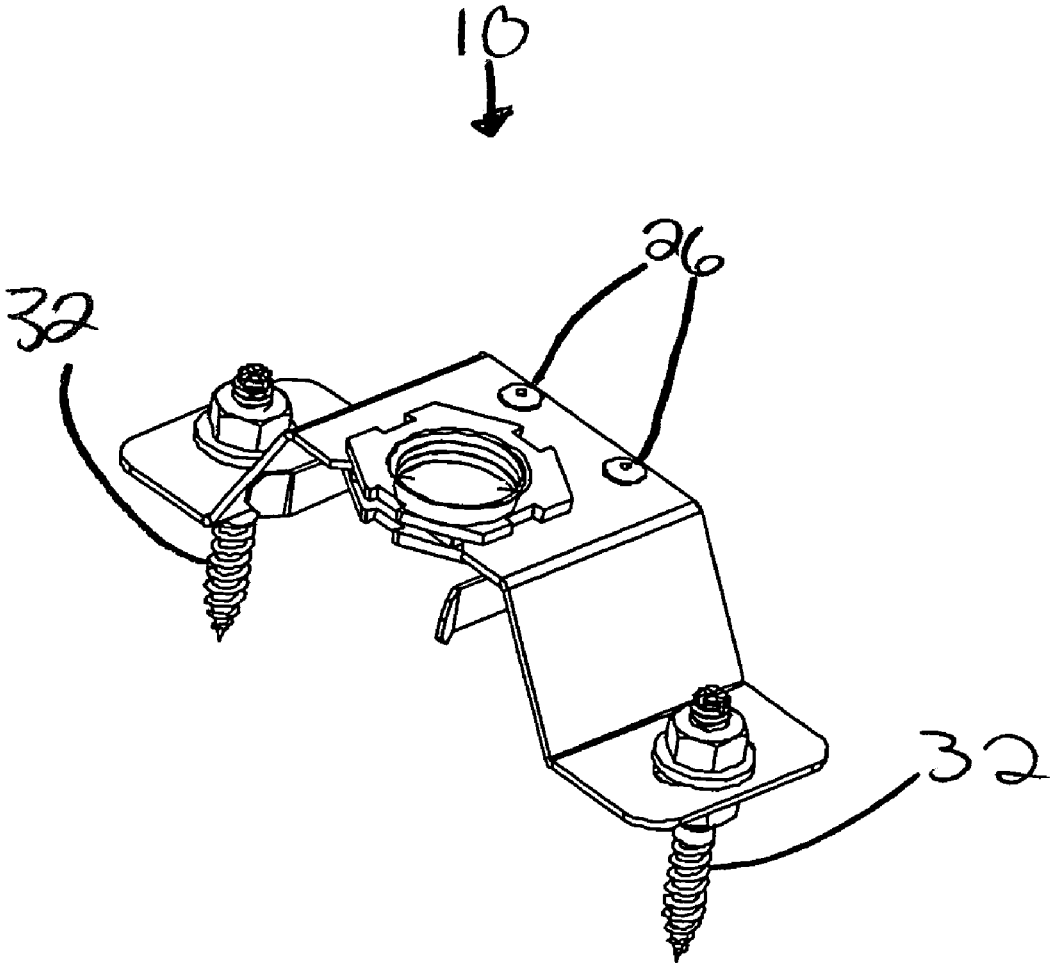
FIG. 5 shows an assembled, elevated perspective view of the mounting bracket of the inventive apparatus.
Figure 6:
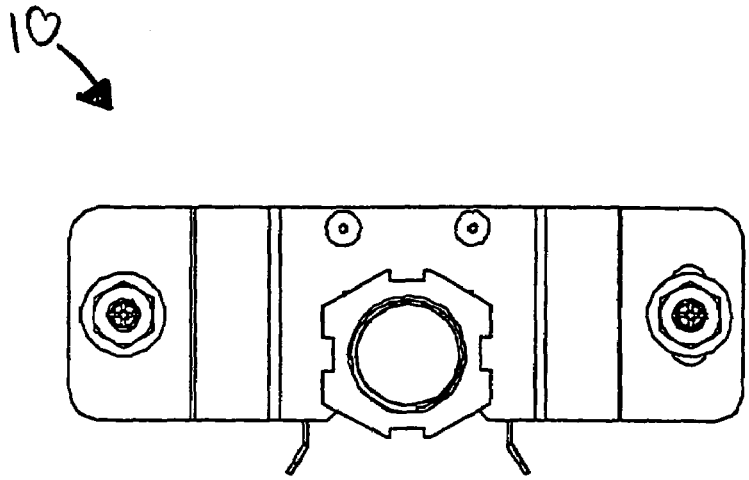
FIG. 6 shows an assembled top view of the mounting bracket of the inventive apparatus.
Figure 6A:
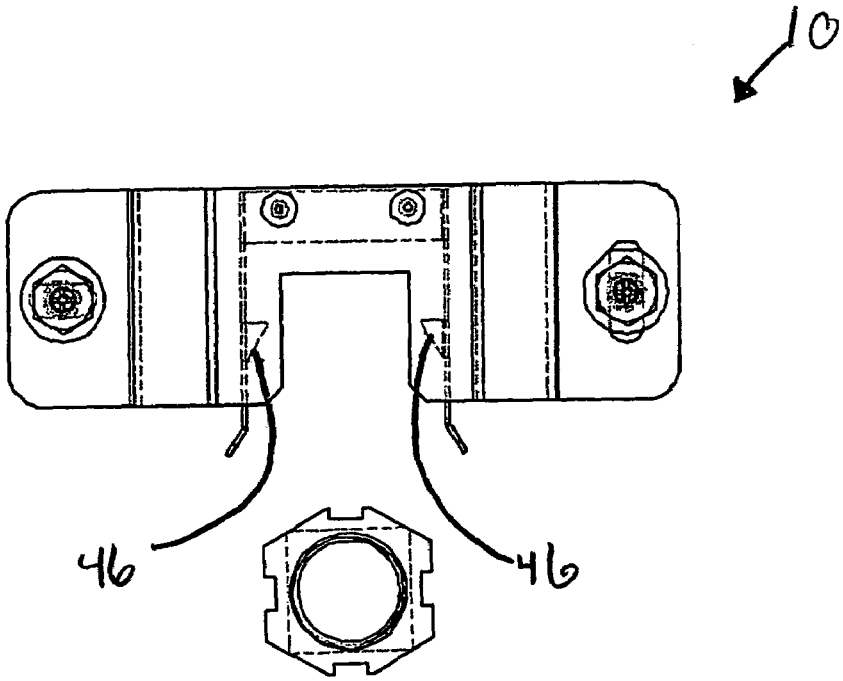
FIG. 6*a* shows a cross-sectional, top view of the mounting bracket of the inventive apparatus.
Figure 7:
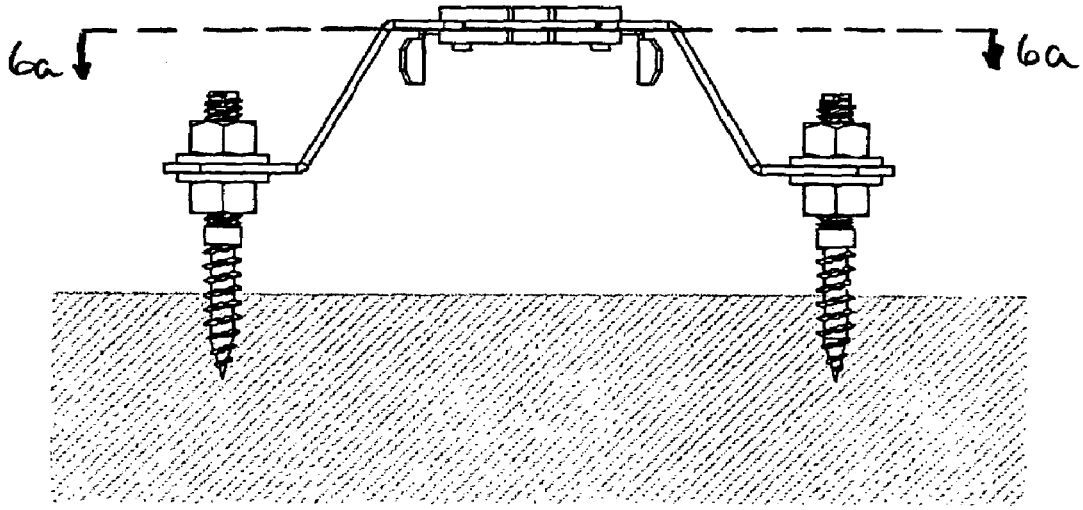
FIG. 7 shows an assembled, front view of the mounting bracket of the inventive apparatus mounted on a substrate.

Initially, FIGS. 1, 2, and 3 show the primary elements of the mounting bracket (10): a main brace (20), a main clamp (40) and a universal nut (50). FIGS. 4, 5, 6, 6*a*, and 7 show how the main brace (20), main clamp (40), and universal nut (50) may be arranged and assembled to form the mounting bracket (10). The main brace (20) consists of a plateau surface (22) connected to two transition surfaces (28) at either side. Each of the transition surfaces (28) are in turn connected to a mounting surface (30). Each of the mounting surfaces (30) include a mounting connection means (32) which comprise a slot for receiving a nail, screw, rivet or other connection means known in the art for securing the mounting surfaces (30) to a substrate. The plateau surface (22) includes a clamp channel (24), which is rectangular in shape, in the preferred embodiment. In alternate embodiments, the clamp channel (24) may be of any shape that would permit the insertion of a universal nut (50) as described below.

While the preferred embodiment describes the main brace (20) as having two transition surfaces (28) and two mounting surfaces (30), the objects of the invention may be achieved through the use of only one transition surface (28) and one mounting surface (30), although less efficiently and less securely. Similarly, the same objects may be achieved through the use of more than two transition surfaces (28) or more than two mounting surfaces (30).

The main clamp (40) consists of a clamp support bar (42), two retaining spring arms (44), and retaining teeth (46) on each of the retaining spring arms (44). The main clamp (40) is connected to the plateau surface (22) of the main brace (20), adjacent to the clamp channel (24), such that the retaining spring arms (44) are on either side of the clamp channel (24). The clamp support bar (42) abuts against the plateau surface (22) and a clamp connection means (26) on the plateau surface (22) operates with a complementary clamp connection means (48) on the clamp support bar (42) to secure the main clamp (40) to the main brace (20). The clamp connection means (26) and complimentary clamp connection means (48) may be any securing means known in the art, including rivets, screws and threaded holes, nuts and bolts, soldering or welding, or any other means known in the art. While the preferred embodiment describes the main clamp (40) as having a clamp support bar (42), it will be understood by persons having ordinary skill in the art that the retaining spring arms (44) may be directly secured to the plateau surface (22) without the use of a clamp support bar (42). In addition, the objects of the present invention may be achieved through the use of only one retaining spring arm (44) having only one retaining tooth (46). Similarly, the same objects may be achieved through the use of more than two retaining spring arms (44), each having a retaining tooth (46).

The universal nut (50) consists of a top octagonal layer (52), a middle square layer (54), and a bottom octagonal layer (56). The top octagonal layer (52) and bottom octagonal layer (56) overlap the middle square layer (54), thereby creating a circumferential channel (60) that follows the perimeter of the universal nut (50). The universal nut (50) has a threaded bore (58) that passes through the center of each of the top octagonal layer (52), the middle square layer (54), and the bottom octagonal layer (56). Each of the top octagonal layer (52) and the bottom octagonal layer (56) include retaining notches (62) on four of the eight sides that coincide with the four sides of the middle square layer (54). While the preferred embodiment describes the universal nut (50) as having both top and bottom octagonal layers (52, 56), the objects of the present invention may be achieved with only one octagonal layer, provided that the universal nut (50) still has a circumferential channel (60).

To use the mounting bracket (10), the mounting surfaces (30) of the main brace (20) are secured to a desired substrate as a tree, a wall, or other surface that requires a light fixture to be mounted through the use of the mounting bracket (10). A light fixture to be secured to a substrate has a threaded mounting stem which is attached to the universal nut (50) through the use of the threaded bore (58). The universal nut (50) is then inserted into the clamp channel (24) of the main brace (20) by sliding the circumferential channel (60) into the clamp channel (24) such that the top and bottom octagonal layers (52, 56) clamp onto the edges of the clamp channel (24). As the universal nut (50) is inserted, the retaining spring arms (44) of the main clamp (40) are forced open through the pressure exerted by the sides of either the top octagonal layer (52) or the bottom octagonal layer (56), whichever happens to engage the retaining spring arms (44) and retaining teeth (46). At a certain point during the insertion, the two retaining teeth (46) engage two of the retaining notches (62) and interlock to secure the universal nut (50) in the clamp channel (24). When the universal nut (50) is in the proper position, the retaining teeth (46) lock the universal nut (50) in place.

The above-described preferred embodiments are intended to illustrate the principles of the invention, but not to limit its scope. Other embodiments and variations of these preferred embodiments will be apparent to those skilled in the art and may be made without departing from the spirit and scope of the invention as defined in the following claims.

I claim:

1. A mounting bracket apparatus comprising:

a main brace including a plateau surface, at least one transition surface connected to the plateau surface, and at least one mounting surface connected to the transition surface, said plateau surface including a clamp channel;

a main clamp connected to the main brace, said main clamp comprising at least one spring retaining arm, the at least one spring retaining arm including a retaining tooth; and a universal nut secured to the main brace and retained by the main clamp;

wherein said universal nut includes a circumferential groove; and wherein the universal nut connects to the clamp channel at the circumferential groove.

2. A mounting bracket apparatus comprising:

a main brace including a plateau surface, at least one transition surface connected to the plateau surface, and at least one mounting surface connected to the transition surface, said plateau surface including a clamp channel;

a main clamp connected to the main brace, said main clamp comprising at least one spring retaining arm, the at least one spring retaining arm including a retaining tooth; and a universal nut secured to the main brace and retained by the main clamp;

wherein said universal nut includes at least one retaining notch;

wherein the at least one retaining notch is adjacent to and interlocks with the retaining tooth of the retaining spring arm.

3. A mounting bracket apparatus comprising:

a main brace including a plateau surface, at least one transition surface connected to the plateau surface, and at least one mounting surface connected to the transition surface, said plateau surface including a clamp channel;

a main clamp connected to the main brace adjacent to said clamp channel, said main clamp comprising at least one spring retaining arm adjacent to said clamp channel, and whereby the at least one spring retaining arm including a retaining tooth; and a universal nut including a circumferential groove and at least one retaining notch, wherein said universal nut is connected to the main brace by the circumferential groove engaging the clamp channel, the universal nut is secured to the main brace by the retaining tooth interlocking with the retaining notch.

* * * * *